US005135602A

United States Patent [19]

Wild

[11] Patent Number: 5,135,602

[45] Date of Patent: Aug. 4, 1992

[54] APPARATUS FOR THE MANUFACTURE OF A PILE FABRIC

[75] Inventor: Thomas W. Wild, Kidderminster, United Kingdom

[73] Assignee: Bondax Carpets Limited, London, United Kingdom

[21] Appl. No.: 535,730

[22] Filed: Jun. 11, 1990

[30] Foreign Application Priority Data

Jun. 16, 1989 [GB] United Kingdom ..... 8913956

[51] Int. Cl.[5] ..... D04H 11/08; D05C 15/04

[52] U.S. Cl. ..... 156/435; 28/159; 156/72

[58] Field of Search ..... 156/435, 72; 28/159; 112/80.01

[56] References Cited

U.S. PATENT DOCUMENTS 3,847,691 11/1974 Currell ..... 156/435 X
3,878,011 4/1975 Currell et al. ..... 156/435 X
4,201,608 5/1980 Currell ..... 156/435 X

FOREIGN PATENT DOCUMENTS 1422524 1/1976 United Kingdom .
1549693 8/1979 United Kingdom ..... 156/72
1549694 8/1979 United Kingdom ..... 156/72
2225351 5/1990 United Kingdom ..... 156/72

*Primary Examiner*—Michael W. Ball
*Assistant Examiner*—Adrienne C. Johnstone
*Attorney, Agent, or Firm*—Spensley Horn Jubas & Lubitz

[57] ABSTRACT

A pile fabric is formed by pressing lengths of yarn through a slot into a layer of adhesive on a pre-formed web. The yarn is pressed through the slot by a presser having at opposite faces respective grooves for receiving end portions of the yarn. While in the grooves, the end portions are constrained to have an upstanding relation with respect to the web.

10 Claims, 3 Drawing Sheets

APPARATUS FOR THE MANUFACTURE OF A PILE FABRIC

BACKGROUND OF THE INVENTION

The present invention relates to the manufacture of a pile fabric by attaching tuft-forming lengths of yarn to a pre-formed web.

Apparatus and a method for the manufacture of pile fabric by attaching tuft-forming lengths of yarn to a pre-formed web are described in GB 1,422,524A, published Jan. 28, 1976. In the method described in this published specification, the web is supported at an attaching station beneath a slot which extends across the width of the web and the web bears on its upwardly facing surface a layer of a hot-melt adhesive. Prior to reaching the attaching station, the adhesive is heated. A row of tuft-forming lengths of yarn are drawn across the top of the slot by means of grippers. A presser member then descends through the slot, pushing a mid-portion of each length of yarn into the layer of adhesive.

End portions of each length of yarn remain in the slot so that they are constrained to have an upstanding relation with respect to the web. After the presser member has been withdrawn from the slot, a pusher moves across the underside of the slot in the direction of feed of the web so that the newly implanted tufts are pushed from the slot beyond a control member at the downstream boundary of the slot. This control member then holds the tufts away from the slot whilst a subsequent row of tufts is implanted in the layer of adhesive.

We have found that it is difficult to ensure that the two limbs of a double tuft attached to the web by the apparatus described in GB 1,422,524A are properly aligned with each other in a direction along the web. There is a tendency for the limbs of a double tuft to depart from the properly aligned relation towards a side-by-side relation. This is a particular disadvantage in a case where the pile fabric has a pattern which includes lines extending along the web and which are intended to be rectilinear. Such lines may be the boundaries between adjacent areas of differently coloured pile.

Lack of proper alignment of the limbs of each double tuft gives the pattern a ragged appearance.

SUMMARY OF THE INVENTION

According to a first aspect of the present invention, there is provided apparatus comprising guide means for guiding a web along a path through an attaching station, tuft-control means defining at the attaching station a slot, the slot being arranged with its length transverse to the length of said path at the attaching station, and pressing means for pressing yarn through the slot onto the web at the attaching station, wherein at least one of the pressing means and the tuft-control means has a yarn-receiving groove and wherein the length of the groove is transverse to both the length of said path at the attaching station and the length of the slot.

Yarn which moves along a yarn-receiving groove during pressing of the yarn onto the web will tend to remain in the groove so that the position of that part of a length of yarn which remains in the groove can be controlled within a small tolerance. Accordingly, particularly in a case where a further portion of the length of yarn is embedded in a layer of adhesive on the web and the adhesive is then permitted to stiffen, a required pattern can be reproduced with greater accuracy than can be achieved with the method and apparatus disclosed in GB 1,422,524A.

In a case where the apparatus is intended to be used to implant U-shaped double tufts, there are provided two yarn-receiving grooves for receiving respective limbs of the double tuft.

The apparatus may be suitable for implanting a complete row of tufts during a single movement of the pressing means through the slot towards the web. In this case, the pressing means extends along substantially the entire useful length of the slot.

Alternatively, the apparatus may be arranged for implanting tufts of one row in succession. In this case, the tuft-control means preferably comprises a dividing member which divides the slot transversely of its length into portions which are arranged sequentially along the slot. The pressing means would then be localised to enter one only of said portions at a time.

According to a second aspect of the invention, there is provided a method of manufacturing a pile fabric wherein a web is moved through an attaching station and tuft-forming lengths of yarn are applied to the web at the attaching station, the attitude and position of the lengths relative to the web being controlled during application of the lengths to the web by tuft-control means at the attaching station, characterised in that a yarn-receiving groove is formed in the tuft-control means and in that a tuft-forming length of yarn is moved into the groove whilst still spaced from the web and remains in the groove whilst the length of yarn is moved to the web.

Preferably, each tuft-forming length of yarn is bent into a U-shape and forms a double tuft, a pair of yarn-receiving grooves is formed in the tuft-control means and the limbs of the double tuft are received in respective ones of said pair of grooves.

BRIEF DESCRIPTION OF THE DRAWINGS

Examples of apparatus embodying the first aspect of the invention and which are used in methods according to the second aspect of the invention will now be described, with reference to the accompanying drawings, wherein.

DETAILED DESCRIPTION

Figure 1:
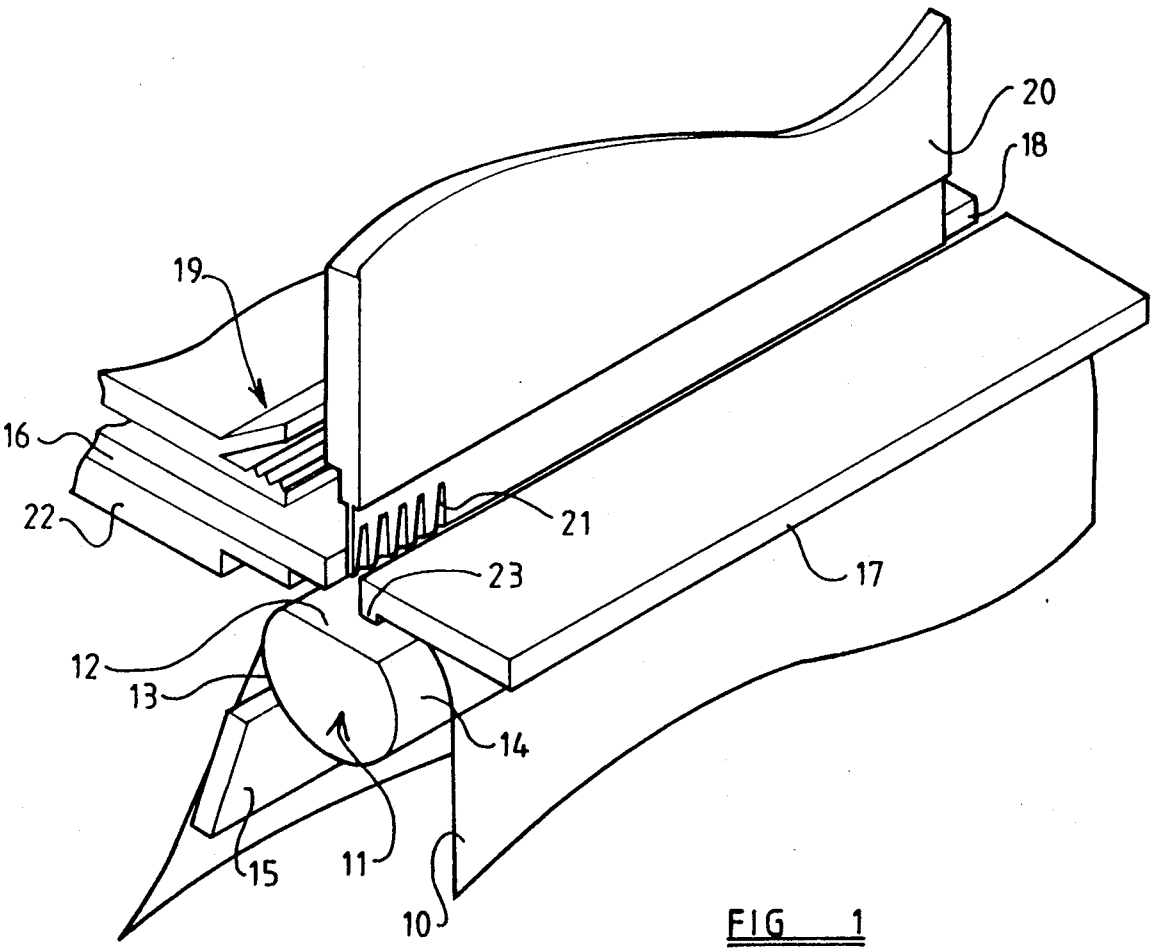
FIG. 1 shows diagramatically certain parts of the apparatus viewed from above and to one side.
Figure 2:
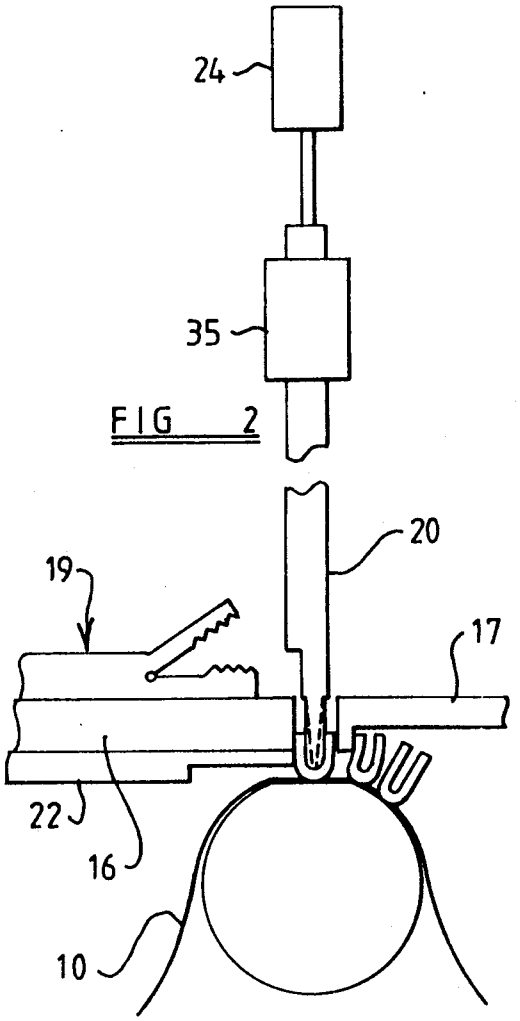
FIG. 2 shows the parts of FIG. 1, as viewed in a direction along the arrow II of FIG. 1.

The apparatus illustrated in FIGS. 1 and 2 comprises guide means for guiding a web 10 along a path which extends from a bulk supply of the web (not shown) through an attaching station shown in FIG. 1 to a take-up roll (also not shown).

The guide means includes a support 11 disposed at the attaching station. The support has a flat surface 12 on which the web 10 rests at the attaching station. The flat surface 12 lies between curved surface portions 13 and 14 of the support, across which curved surface portions the web 10 approaches and leaves the flat surface 12.

The guide means for the web may be arranged generally as described and illustrated in GB 1,422,524A and may include an accumulator for accumulating a variable length of the web and means for maintaining a required tension in the web.

On one face of the web, that face which is spaced away from the support 11, there is provided a layer of a hot-melt adhesive. The apparatus includes a heater 15 for heating the adhesive upstream of the attaching station. The heater is disposed immediately adjacent to the path along which the web 10 approaches the support 11 and is arranged to transfer heat to the adhesive layer through the web 10. This establishes a temperature gradient in the layer of adhesive such that the viscosity of the adhesive is lower immediately adjacent to the web 10 and is higher at the exposed surface of the layer of adhesive.

At the attaching station, there is provided tuft-control means for controlling tufts as these are implanted in the layer of adhesive on the web 10 and immediately after the tufts have been implanted. The tuft-control means includes upstream and downstream control members 16 and 17 respectively which are spaced apart in a direction transverse to the direction of movement of the web 10 to define a slot 18 extending across the entire width of the web. The slot lies directly above the flat surface 12 of the support 11. The slot 18 is rectilinear and is of uniform width. The opposite boundary surfaces of the slot are flat, mutually parallel and perpendicular to the flat surface 12.

suitable means for guiding and driving the presser member are disclosed in GB 1,422,524A. By way of example, there is represented in FIG. 2 a guide 35 which is fixed with respect to a frame of the apparatus and through which the presser member 20 slides and a piston and cylinder unit 24 connected with the presser member to reciprocate the presser member relative to the frame. It will be understood that a number of piston and cylinder units may be provided, depending upon the length of the presser member. Furthermore, instead of a single guide 35, there may be provided a row of guides, separate upwardly projecting limbs of the presser member extending through respective ones of the guides.

Immediately adjacent to the upwardly facing surface of either one of the tuft-control members 16 and 17, there is provided delivery means for delivering a row of tuft-forming lengths of yarn to the attaching station. The particular example of delivery means illustrated in FIG. 1 is a set of grippers 19.

Drive means of known form is provided for reciprocating the grippers and for opening and closing the grippers to seize yarns in a known manner. A known source of yarns, for example a number of spools, may be provided for presenting yarn ends for seizing by the grippers 19. A suitable source of yarns and suitable means for operating the grippers are disclosed in GB 1,422,524A.

The apparatus also includes a presser member 20 mounted for reciprocation towards and away from the support 11 through the slot 18. Drive means is provided for moving the presser member between the raised position illustrated in FIG. 1 and a lowered position in which the presser member extends downwardly through the slot substantially to the level of the layer of adhesive on that part of the web which rests on the flat surface 12.

In the raised position, the presser member 20 is spaced sufficiently far above the control members 16 and 17 to permit the grippers 19 to move across the top of the slot 18 to the source of yarn ends and to return, drawing portions of yarn across the slot.

The presser member 20 is rectilinear and has a length substantially equal to the length of the slot 18. The width of the presser member is slightly less than the width of the slot, so that the presser member can move into the slot with clearance between the presser member and the control members 16 and 17.

On each of the upstream and downstream faces of the presser member 20, there is formed a respective row of yarn-receiving grooves 21. The grooves are arranged in pairs with one groove on the upstream face of the presser member being aligned in the direction of travel of the web 10 through the attaching station with a corresponding groove in the downstream face of the presser member. The number of pairs of grooves corresponds to the number of lengths of yarn which form a single row of double tufts on the web. The pitch of the grooves along each row is equal to the pitch of the tufts along the rows of the finished pile fabric. Each of the grooves 21 is arranged with its length perpendicular to the length of the slot 18 and perpendicular to the direction of travel of the web 10 through the attaching station.

The tuft-control means further comprises a pusher 22 disposed at the downwardly facing surface of the upstream control member 16 and arranged for reciprocation between a position in which the pusher lies entirely beneath the upstream control member and a projected position in which the pusher extends across the bottom of the slot 18 and overlaps with a downwardly projecting lip 23 formed on the downstream control member 17 immediately adjacent to the slot.

The drive means for advancing the web 10, driving the spools or other source of yarn, reciprocating and operating the grippers 19, operating a knife (not shown) to sever the tuft-forming lengths of yarn from the bulk supply, for reciprocating the presser member 20 and for reciprocating the pusher 22 may be substantially as disclosed in GB 1,422,524.

When the apparatus illustrated in FIGS. 1 and 2 is in operation, the grippers 19 are advanced past the slot 18 to seize the ends of yarn from the bulk supply of yarns. The grippers then return to draw tuft-forming lengths of yarn from the source. These lengths are severed from the bulk supply in a known manner by an automatically operated knife. The lengths of yarn are drawn across the slot 18 until a mid-portion of each length is directly above the slot. The presser member 20 then descends to engage each length of yarn and to push the mid-portion of each length through the slot 18 into the layer of adhesive on the web 10. Opposite end portions of each length follow the mid-portion through the slot. However, end portions of the lengths remain in the slot 18 when the mid-portion has been embedded in the layer of adhesive. This ensures that the limbs of each newly implanted double tuft have an upstanding relation with respect to the web.

The yarn ends are presented by the bulk supply in positions such that, when the tuft-forming lengths of yarn are drawn by the grippers 19 across the slot 18, each length of yarn lies directly beneath a pair of yarn-receiving grooves 21 in the presser member 20. It will be noted that the lower edge of the presser member has a scolloped form. As the presser member descends to engage the lengths of yarn, each length is seated in a respective scollop of the lower edge of the presser member. As the presser member descends into the slot, each length of yarn is bent into a U-shape. The opposite limbs of the U enter the corresponding grooves 21 in the presser member.

The clearance between the presser member and the control members 16 and 17 is sufficiently small to ensure that the limbs remain in the yarn-receiving grooves. This ensures that each limb of each double tuft has a perpendicular relation to that part of the web 10 which rests on the flat support surface 12 and that this relation is maintained during embedding of the mid-portion of each tuft in the layer of adhesive.

Furthermore, the yarn-receiving grooves ensure that the two limbs of a single tuft are exactly aligned with one another in the direction of travel of the web 10 through the attaching station.

If required, yarn-receiving grooves may be formed also in the surfaces of the control members 16 and 17 which face each other across the slot.

Furthermore, the yarn-receiving grooves could be formed in the control members 16 and 17 as an alternative to forming grooves in the presser member 20.

After the mid-portion of each double tuft of a row has been embedded in the layer of adhesive on the web 10, the presser member 20 is withdrawn from the slot 18. The pusher 22 then advances across the bottom of the slot to push the end portions of the tufts of the row from the slot to a position beyond the lip 23. When the pusher 22 withdraws from the tufts, the lip ensures that the tufts do not return to obstruct the slot. During pushing of the tufts from the slot, the web 10 is advanced through the attaching station by a distance corresponding to the pitch of successive rows of double tufts along the web.

Figure 3:
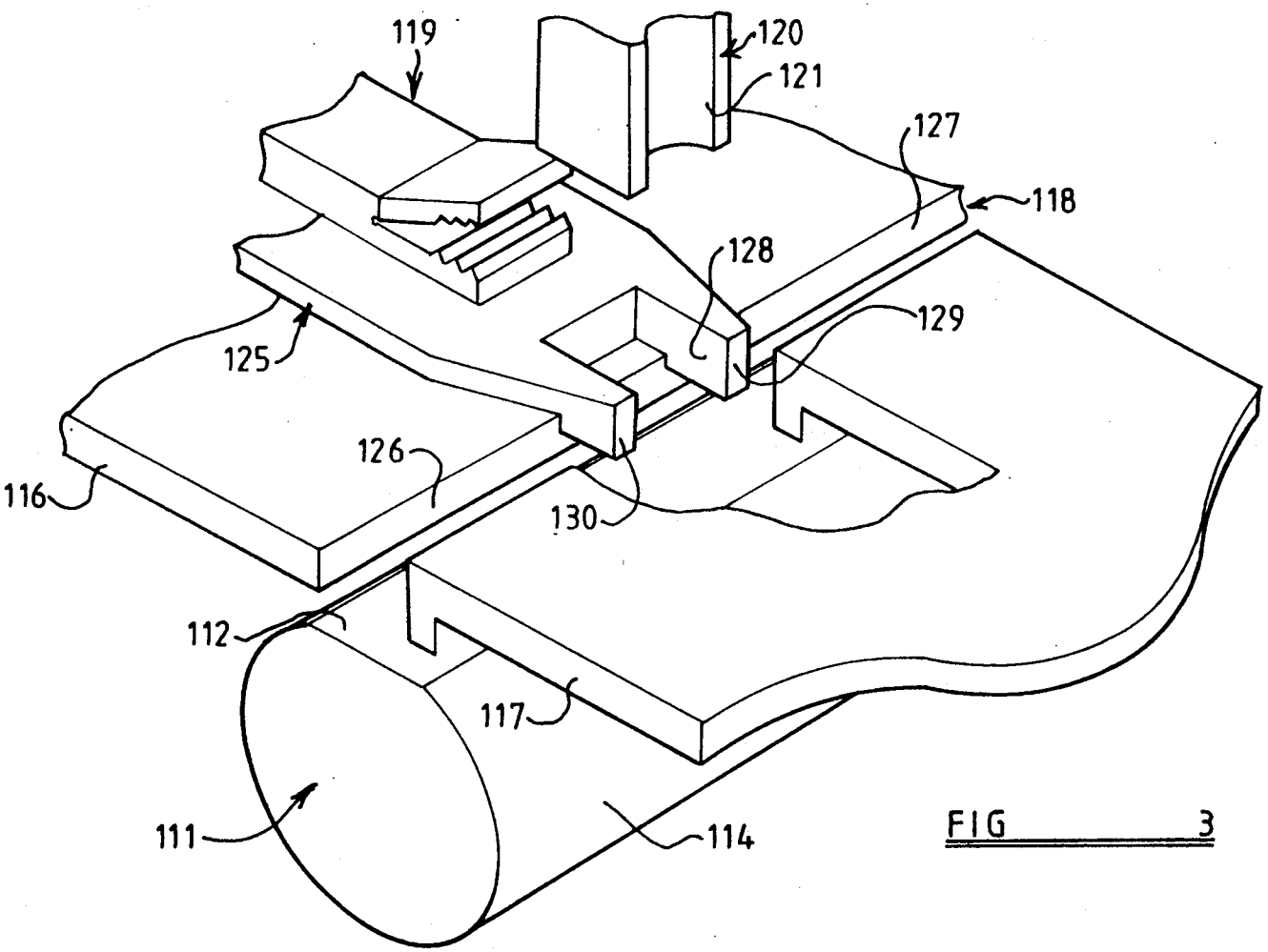
FIG. 3 illustrates modifications of the apparatus of FIGS. 1 and 2.
Figure 4:
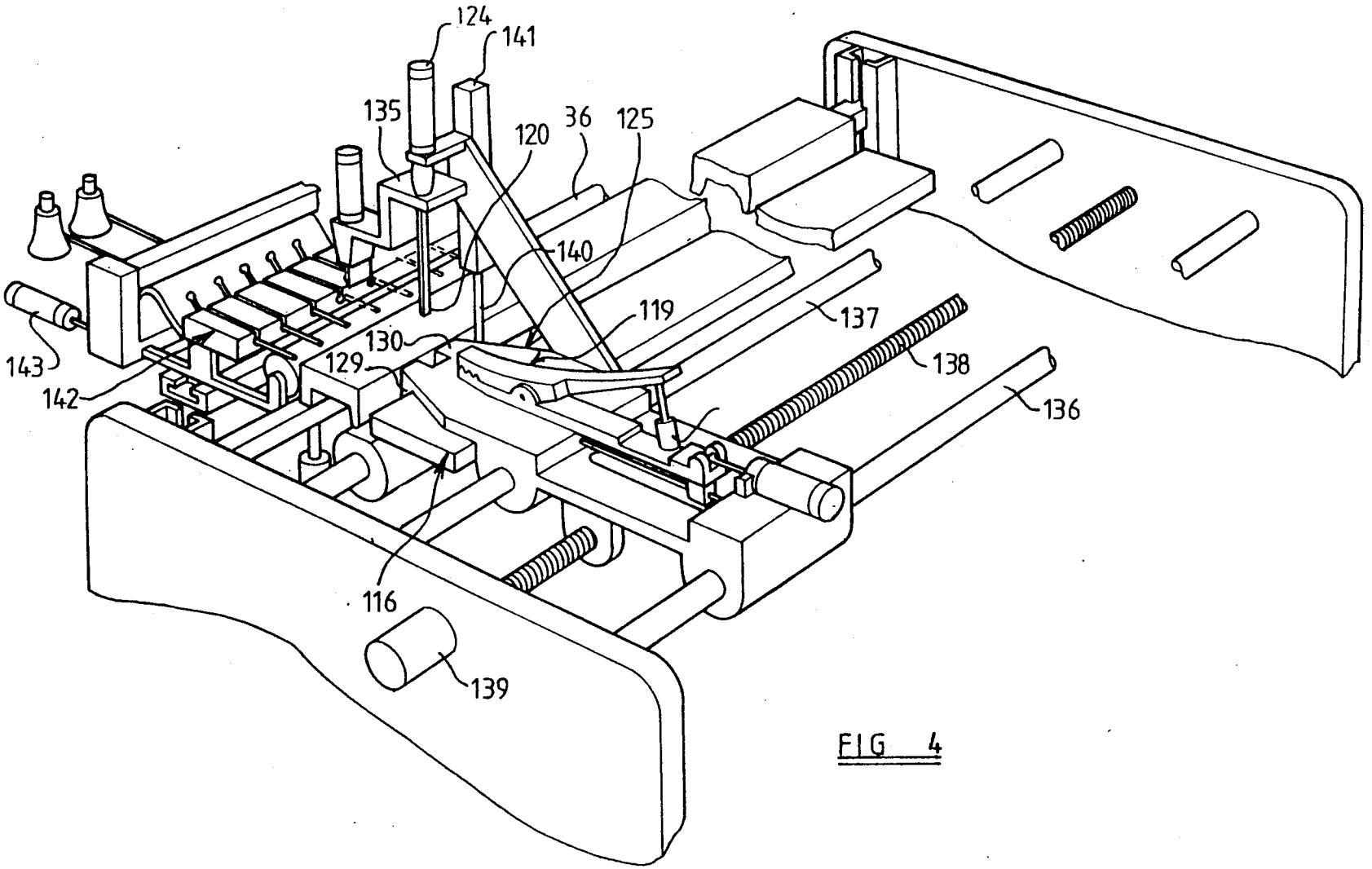
FIG. 4 illustrates further parts of apparatus incorporating the arrangement of FIG. 3.

Certain modifications of the apparatus of FIGS. 1 and 2 are illustrated in FIGS. 3 and 4. In FIGS. 3 and 4, parts corresponding to those hereinbefore described with reference to FIGS. 1 and 2 are identified by like reference numerals with the prefix 1. Such preceding description is deemed to apply to the apparatus of FIGS. 3 and 4, except for the differences hereinafter mentioned.

The apparatus of FIGS. 1 and 2 is intended to implant all double tufts of a row concurrently. The modified apparatus of FIGS. 3 and 4 is intended to implant tufts of a row sequentially. The tufts may be implanted one at a time. Alternatively, the apparatus may be adapted to implant several tufts of a row concurrently at respective positions which are spaced apart by distances considerably greater than the pitch of tufts along the row.

For simplicity of illustration, there is shown in FIG. 3 means for implanting a single tuft. The arrangement may be duplicated for implanting two tufts at a time.

The modified apparatus of FIG. 3 includes a dividing member 125 which divides the slot 118 transversely of its length into three portions arranged in succession along the length of the slot. These are first end portion 126, a second end portion 127 and an intermediate portion 128 which lies between the end portions. The dimensions of the intermediate portion 128 are fixed. The dividing member is movable along the slot to vary the lengths of the end portions 126 and 127.

The presser member 120 of the apparatus shown in FIG. 3 has dimensions such that it can be received with clearance in the intermediate portion 128 of the slot. The presser member can be moved along the slot to maintain alignment of the presser member with the intermediate portion of the slot. That dimension of the intermediate portion which extends along the slot is short, relative to the overall length of the slot and preferably does not exceed twice the width of the slot. The width of the slot is typically no more than 2% of the length of the slot.

There is formed in each of the upstream and downstream faces of the presser member 120 a single yarn-receiving groove. These grooves are mutually aligned in the direction of movement of the web through the attaching station.

The means for delivering tuft-forming lengths of yarn to the attaching station of the modified apparatus shown in FIG. 3 may be the same as the delivering means used in the apparatus of FIGS. 1 and 2. However, since yarn lengths are required to be moved individually to the attaching station, a gripper 119 which has a relatively short dimension extending in a direction along the slot 118 may be used. This dimension of the gripper is preferably several times the thickness of an uncompressed length of yarn, so that there is no significant risk of the gripper failing to grip the length securely.

In a case where a relatively narrow gripper is used, it is necessary for the gripper to travel along the slot with the dividing member 125 so that the gripper delivers each length of yarn to a position overlying the intermediate portion 128 of the slot.

There may be used with the modified apparatus of FIG. 3 a source of yarn which is the same as that used in conjunction with the apparatus of FIGS. 1 and 2.

Alternatively, there may be used a source of yarn which includes only a single yarn length of each colour to be used in the manufacture of the pile fabric. Relative movement of the gripper and yarn source are then used to select yarn of appropriate colour for each length which is to be attached to the web. An example of such a source of yarn is illustrated in FIG. 4.

The dividing member 125 preferably has opposite wall portions 129 and 130 which depend into the slot 118 at opposite ends of the intermediate portion of the slot. One of these wall portions can be used to control the attitude of the last-implanted tuft during implanting of an adjacent tuft of the row. For this purpose, it is necessary for the wall portions 129 and 130 to approach the flat support surface 112 sufficiently closely to ensure that these wall portions will overlap with the free end portions of an implanted tuft.

After a double tuft has been implanted in the layer of adhesive on the web, the dividing member 125 is moved along the slot 118 sufficiently far to ensure that the newly implanted tuft escapes from the intermediate portion 128 of the slot into one or other of the end portions 126 and 127. The dividing member is then returned along the slot towards the newly implanted tuft to the position where an adjacent tuft is to be implanted. The presser member 120 and the gripper 119 follow this movement of the dividing member 125.

FIG. 4 shows guide bars 136 and 137 for guiding the dividing member, the presser member, and a gripper for reciprocation relative to a frame of the apparatus in a direction parallel to the length of the slot 118. These guide bars are fixed with respect to the frame. FIG. 4 also shows a lead screw 138 and a motor 139 for driving the dividing member, the presser member and the gripper together along the guide bars 136, 137. Transducers, not shown, may be used to provide electrical signals representing movement of or the positions of these components of the apparatus and the apparataus may include an electronic controller for controlling the drive means.

FIG. 4 also shows a source 141 of hot air and a delivery means 140 for delivering air from the source 141 to a position where the next tuft is to be implanted in the layer of adhesive.

The source of yarn illustrated in FIG. 4 comprises a number of lengths of differently coloured yarns with end portions of these yarns guided by a guide block 142 to a presentation station, where the yarn ends are presented for gripping by the gripper 119. The source of yarns, including the guide block 142, can be reciprocated towards and away from the slot 118 by means of a piston and cylinder unit 143 to cause the required length of a yarn which has been gripped by the gripper to be drawn off from the source. The source of yarn ends can also be reciprocated in a direction along the slot 118 to bring a selected yarn end into alignment with the gripper.

The claims defining the invention are as follows:

1. Apparatus having an attaching station and comprising guide means for guiding a web along a path through the attaching station, tuft-control means defining at the attaching station a slot, the slot being arranged with its length transverse to the length of said path at the attaching station, and pressing means for pressing yarn through the slot onto the web at the attaching station, wherein at least one of the pressing means and the tuft-control means has a yarn-receiving groove and wherein the length of the groove is transverse to both the length of the said path at the attaching station and the length of the slot, wherein the tuft-control means comprises a dividing member which divides the slot transversely of its length into portions which are arranged sequentially along the slot and wherein the pressing means is localized to enter only one of said portions at a time.

2. Apparatus according to claim 1 wherein there are two yarn-receiving grooves for receiving respective limbs of a single, substantially U-shaped double tuft.

3. Apparatus according to claim 1 wherein the yarn-receiving groove is formed in the pressing means.

4. Apparatus according to claim 3 wherein the tuft-control means defines flat, opposed boundaries of the slot.

5. Apparatus according to claim 1 wherein the dividing member is movable along the slot.

6. Apparatus having an attaching station and comprising guide means for guiding a web along a path through the attaching station, tuft-control means defining at the attaching station a slot, the slot being arranged with its length transverse to the length of said path at the attaching station, and pressing means for pressing yarn through the slot onto the web at the attaching station, wherein at least one of the pressing means and the tuft-control means has a yarn-receiving groove and wherein the length of the groove is transverse to both the length of the said path at the attaching station and the length of the slot wherein the dividing member divides the slot into an intermediate portion and two end portions and wherein the pressing means is positioned to enter only the intermediate portion.

7. Apparatus according to claim 6 wherein the intermediate portion has a length no greater than twice the width of the slot.

8. Apparatus according to claim 6 wherein there are two yarn-receiving grooves for receiving respective limbs of a single, substantially U-shaped double tuft.

9. Apparatus according to claim 6 wherein the yarn-receiving groove is formed in the pressing means.

10. Apparatus according to claim 9 wherein the tuft-control means defines flat, opposed boundaries of the slot.

* * * * *